United States Patent [19]

Mueller

[11] Patent Number: 4,524,482

[45] Date of Patent: Jun. 25, 1985

[54] UNITARY RESILIENT BEARING SUPPORT

[76] Inventor: Christoph Mueller, Kleiner Muristalden 28, CH-3006 Bern, Switzerland

[21] Appl. No.: 457,902

[22] Filed: Jan. 14, 1983

[30] Foreign Application Priority Data

Jan. 22, 1982 [DE] Fed. Rep. of Germany ..... 3202007

[51] Int. Cl.[3] ..... B60B 33/00

[52] U.S. Cl. ..... 16/44; 16/DIG. 36; 190/18 A; 267/63 R; 267/157

[58] Field of Search ..... 16/37, 38, 39, 42 T, 16/43, 44, DIG. 36; 190/18 A; 267/63 R, 153

[56] References Cited

U.S. PATENT DOCUMENTS

| | | | |
|---|---|---|---|
| 163,863 | 6/1875 | Geer | 16/44 |
| 2,361,529 | 10/1944 | Briggs | 16/DIG. 36 X |
| 2,980,944 | 4/1961 | Bolinger | 16/44 X |
| 3,315,951 | 4/1967 | Boschi et al. | 267/63 R X |
| 3,799,568 | 3/1974 | Hager | 190/18 A X |
| 3,806,106 | 4/1974 | Hamel et al. | 267/63 X |
| 4,335,896 | 6/1982 | Koffler et al. | 190/18 A X |

FOREIGN PATENT DOCUMENTS

| | | | |
|---|---|---|---|
| 499414 | 1/1939 | United Kingdom | 267/63 |
| 629434 | 9/1949 | United Kingdom | 16/44 |
| 641316 | 8/1950 | United Kingdom | 267/63 |
| 785295 | 10/1957 | United Kingdom | 16/44 |
| 861382 | 2/1961 | United Kingdom | 16/44 |
| 860352 | 2/1961 | United Kingdom | 16/44 |
| 2050158 | 1/1981 | United Kingdom | 16/44 |

*Primary Examiner*—Fred A. Silverberg

*Attorney, Agent, or Firm*—Barnes & Thornburg

[57] ABSTRACT

A resilient bearing support is provided for suitcase rollers and the like. A single part made of resilient material is configured to rotatably support travel rollers in a lower fork-like projection. The tip of this part is connected to a lower corner of a frame of a suitcase. To facilitate desired shock absorbing characteristics, the part is provided with a transversely extending triangular opening. The shortest side of this opening is bounded by a thin wall section that is curved outwardly to accommodate flexure of this wall during compression of the part. The other two sides of the triangular opening are curved inwardly to roll on one another to increase the resistance of the bearing part to compression in response to increasing loads.

5 Claims, 4 Drawing Figures

UNITARY RESILIENT BEARING SUPPORT

BACKGROUND AND SUMMARY OF THE INVENTION

The present invention relates to an elastic bearing support for suitcase rollers or the like. Such a bearing support rotatably supports rollers or wheels at its bottom area and exhibits an upper portion connected to or connectable to a support frame of a suitcase or other container. By means of such a bearing support, one can mount rollers on a suitcase and can then roll the suitcase instead of having to carry the same.

Previous arrangemcnts of this kind have been contemplated where the rollers are supported at a mounting or bearing support part, which support part is in turn fastened to a belt or a strap which can be engaged around the suitcase. There have also been suitcases, especially of plastic, where two rollers are permanently built-in. Further, for substantially the same purposes, light collapsable material carriers have been contemplated which have longitudinal supports telescopically collapsable within one another.

German Pat. No. PS845839 discloses a traveling suitcase or trunk on rollers, wherein the rollers are resilently supported on supports which are pivotal into and out of pockets on the sidewalls of the suitcase.

French Pat. No. 1,487,437 discloses a bearing part for a suitcase roller which is made in the form of a spiral spring with one leg fastened to the suitcase floor and one or two suitcase rollers supported on another leg inclined diagonally toward the bottom.

The above-noted previously contemplated arrangements with resilient support of the rollers exhibit disadvantages in that they are too complicated, bulky, and expensive.

German No. PS806704 discloses a trayeling suitcase wherein the rollers are supported in pivotal bearing blocks. Although these bearing blocks can also have openings in their walls, they are themselves stiff and provide no effective resilient support for the rollers.

The invention is based upon the problem of providing a resilient shock absorbing bearing support or part for suitcase rollers and the like, which is especially simple and robust in form and is economically manufactured. This problem is solved according to the invention by forming the bearing support from a block of resilient material and by providing a substantially triangular shaped opening in the resilient material, whereby the shock forces caused by relative movement between the rollers and the suitcase frame supported thereon are resiliently absorbed in a predetermined desirable manner by compression of the resilient material, as well as by bending or flexing of at least one sidewall of the triangular opening.

In especially preferred embodiments the triangular opening is dimensioned and oriented so that the shortest triangular side at the rear side of the bearing support when in an in use position at a bottom corner of a suitcase with the diagonally opposite suitcase corner being pulled via a pulling handle connected thereto. Preferably the other two sides of the triangular opening converge at the apex of the opening in an arrow-like manner, pointing in the travel direction of the support rollers.

The bearing part is formed out of a rubber elastic material and is so formed that the desired elasticity and shock absorbing characteristics are obtained. Instead of using a special separate spring, which would make the bearing part complicated and expensive, the invention provides that the bearing part for the support or the feet is itself resilient/elastic.

The bearing support extends diagonally upwardly at a bottom corner of the suitcase being supported and has the substantially triangular opening extending laterally, at a position located diagonally and above the roller axles. The triangular opening is so oriented that the one side substantially parallel to the rear upward side of the resilient support exhibits a relative thin wall which is slightly curved outwardly and rearwardly. With this arrangement loads on the bearing support cause this thin wall to resiliently deflect and form a small arched wall part. The two other triangular sides extend in the travel direction approximately as an arrow point. The vertex of the triangular opening is located at the tip of this arrow shape in the area of the forward and lower side of the bearing part, oppositely of the arched upward and rearward thin wall part. The bearing part forward side is shorter than its curyed rearward upwardly extending side forming the thin wall part.

The thin wall part which is arched toward the rear and upwardly can elastically deflect and absorb shocks with a wide range of bending movement of the arched thin wall part. The other two triangular sides effectively pivot about the apex during the flexing movement of the thin wall part. With this elastic pivoting movement, the described forward lower region of the bearing part serves as a joint or articulation part.

Advantageously the two sides of the triangular opening which extend in the travel direction are arched convexly toward the center of the triangle so that they roll upon one another during the pivotal movements. In this manner they shorten the effective sides of the triangle during the elastic movement so that the support area becomes larger and the further elastic absorption is accomplished by an increasing resistance and the stability and the spring strength is simultaneously increased in conjunction with the corresponding increasing shock forces experienced at the rollers. With this arrangement there is thus simultaneously an oyerload prevention because of increased resistance to higher shock forces. The small, but frequent shocks and shaking,are elastically absorbed in a smooth manner, but also the strong shocks are correspondingly dampened by the advantageous spring path provided by this arrangement.

It is also noted that such an elastic bearing part or support embodiments are contemplated to be used on other containers than for suitcases.

Another preferred embodiment contemplates use of such bearing supports at the bottom side of a backsack or rucksack, at a support frame. Also small transport carts or wagons can be provided with such elastic bearing parts for the wheels.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
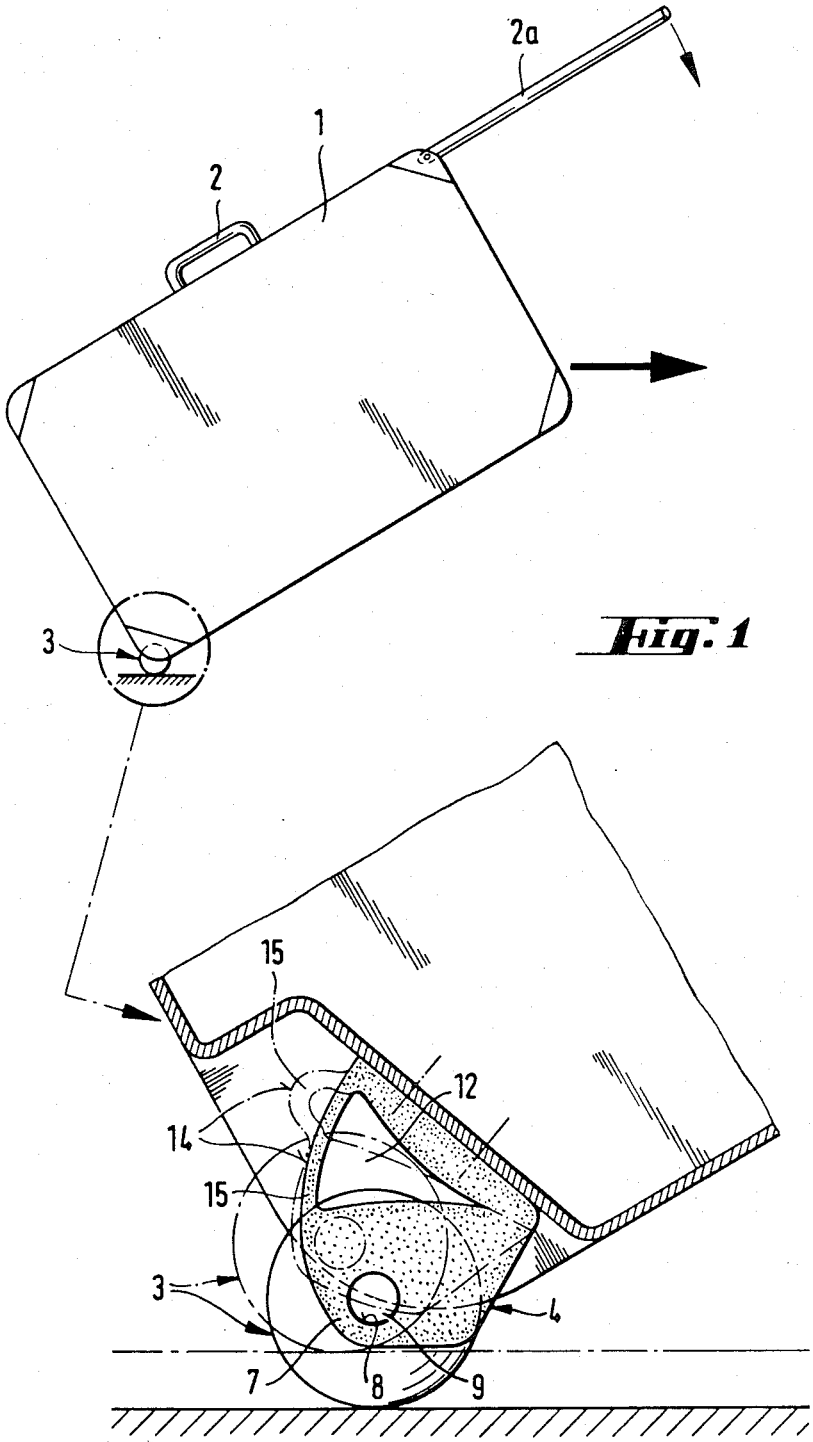
FIG. 1 is a schematic side view of a suitcase which has suitcase rollers supported by a resilient bearing support constructed in accordance with a preferred embodiment of the present invention.

Referring to FIG. 1, a suitcase 1 is provided with a carrying handle 2 and at the opposite lower corner is provided with suitcase rollers 3. Rollers 3 are supported by means of resilient bearing support 4 connected to the suitcase 1. At the diagonally opposite corner of the suitcase from the rollers 3, a collapsable pulling handle 2A is provided for pulling the suitcase along on the rollers 3.

Figure 2:
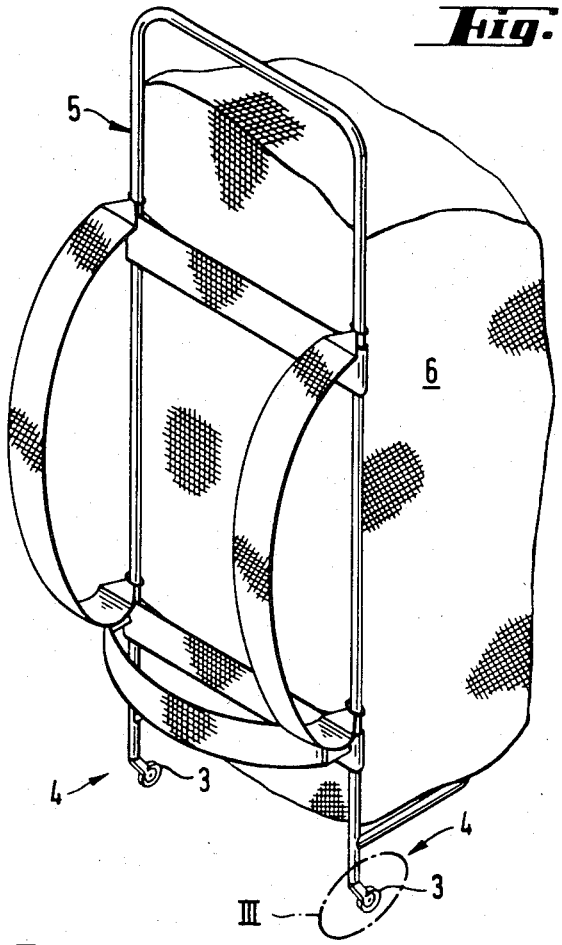
FIG. 2 is a schematic side view showing a backpack which has rollers supported by a resilient bearing support constructed in accordance with another preferred embodiment of the present invention.

FIG. 2 schematically depicts a resilient elastic bearing part 4 for supporting rollers 3 provided at each of the respective lower ends of the support tubes of support frame 5 of a backpack 6.

Figure 3:
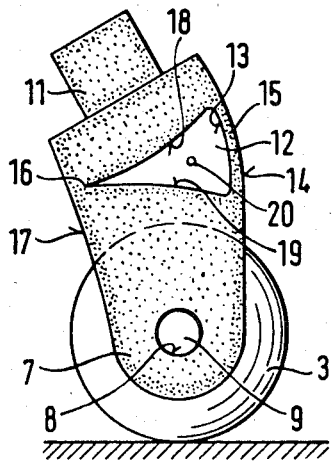
FIG. 3 is an enlarged schematic side view of a resilient bearing support and roller constructed in accordance with another preferred embodiment of the present invention, shown in an unloaded condition.
Figure 4:
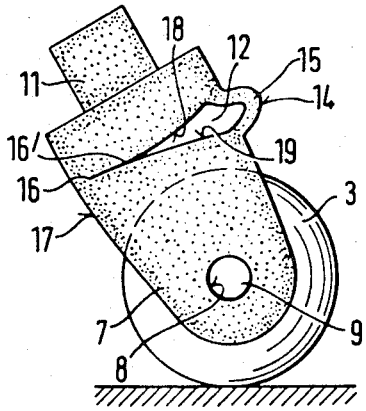
FIG. 4 is a view similiar to FIG. 3, showing the bearing support in a loaded condition.

The construction of an exemplary embodiment of the resilient bearing part 4 is shown in more detail in FIGS. 3 and 4 and in the enlarged section at the lower part of FIG. 1. Like reference characters are used for corresponding features of the resilient bearing supports of FIGS. 1 and of FIGS. 3 and 4, though these embodiments are slightly different in exterior shape, because the shock absorbing triangular hole features are similar.

The resilient bearing part 4 is provided on its bottom end with two fork arms 7 with a bearing 8 for rotatably supporting the axle 9 of a roller 3. At the upper end of the bearing part 4, a pin 11 is proyided which is insertable in the support tubes of the frame 5 of the backpack shown in FIG. 2 (FIGS. 3 and 4). The upper end of the bearing part can also be fastened in other ways For example it can be rivited or fixed by adhesive at a strengthened wall-part of a suitcase reinforced part as schematically shown in the FIG. 1 embodiment.

The desired elastic shock absorbing resilence characteristics of the bearing part 4 are obtained according to the invention by the provision of a substantially triangular opening 12 between the upper part of the part 4 (pin 11 of FIGS. 3 and 4, or the surface adhered or riveted to the lower corner of the suitcase in FIG. 1) and the lower fork arms 7. Side 13 of the triangular opening, which in use is at the rear upper diagonal side of support 4, is arched outwardly from the center of the opening 12 and extends parallel to the upper rear surface 14 of support 4, to form a relatively thin arched wall part 15. The thin arched wall part 15 is disposed oppositely to the apex 16 located near the forward lower shorter side 17 of the bearing and support part 4. In this apex 16, the two remaining triangular wall sides 18 and 19 extend like an arrow point, pointing substantially in the travel direction (see arrow in FIG. 1). These triangular sides 18 and 19 are arched in the direction of the middle 20 of the triangular opening.

In FIG. 4 there is shown the shock absorbing condition of the resilient support 4. Here the wall part 15 is strongly bent and resiliently compressed while simultaneously the two sides 18 and 19 are rolled together from the apex 16 so that the apex 16 is effectively moved in the rearward direction (16'), whereby the two sides 18 and 19 between the apex point 16 and apex point 16' abbutingly engage one another and thereby build an increased support area, with which further compression results in a corresponding increasing resistance. In other preferred embodiments the sides 18 and 19 are more strongly arched outwardly than as shown in the drawings so that an elastic pulling zone results on the forward lower shorter side 17 of support part 4.

According to other preferred embodiments, the opening 12 is disposed further in the lower direction into the fork arms 7, whereby sufficient space above the rollers 3 must be provided for accommodating the springing movement connection of the rollers.

While I have shown and described several embodiments in accordance with the present invention, it is understood that the same is not limited thereto but is susceptible to numerous changes and modifications as would be known to those skilled in the art of the present disclosure and I therefore do not wish to be limited to the details shown and described therein but intend to cover all such changes and modifications as are encompassed by the scope of the appended claims.

I claim:

1. Bearing support for a container which is adapted to be rolled along a support surface via transport roller means disposed on rotatable axle means at the bottom of the container comprising:

a unitary resilient bearing part having upper and lower portions and a cavity of substantially triangular cross section extending therethrough at a position between said upper and lower portions, said cavity being delimited by three cavity walls and three parallel apices formed by the respective intersection of said cavity walls, wherein said triangular cavity has one short side and two other sides longer than said short side, said short side positioned on a rear position of the bearing support when said support is in a forward travelling condition, wherein one of said walls at said short side is curved slightly outward with respect to points within said triangular cavity so that a compression of the bearing part results in a bending flexure of said one wall, wherein the other two walls of the triangular cavity are curved to arch in a convex shape relative to points within the triangular cavity, wherein the other two walls are configured to increasingly abuttingly engage one another from the apex toward said short side in response to increased compression of the bearing part and resulting shortening of said short side, whereby the resistance to compression of said bearing support is increased as the compression forces are increased, roller bearing means integral with said lower portion of said resilient bearing part for rotatably supporting said axle means, and connecting means integral with said upper portion of said resilient bearing part for connecting said bearing part to container frame means, wherein, in use, said one wall of said cavity is substantially perpendicular to said supporting surface and the apices of said cavity are parallel to said axle means whereby shock forces effecting relative movement of said roller means and said frame means are resiliently absorbed by compression of said resilient bearing part, by flexural bending of said one wall of said triangular cavity and by elastic pivoting movement of the remaining two walls of said cavity about their respective apex.

2. Support according to claim 1, wherein the bearing part exhibits an upper surface extending diagonally when in use on the container being pulled in a forward traveling direction with a forward end of the container raised above a rear end at which the roller means is located.

3. Support according to claim 1, wherein the connecting means includes a protrusion at the top of said bearing part for engagement into a tubular member at the frame.

4. Support according to claim 1, wherein said bearing part includes downwardly extending fork legs which accomodate the roller bearing means.

5. Support according to claim 1, wherein a forward side of said bearing part facing a forward direction when said support is in the forward travelling condition is shorter than a rear side of said bearing part facing a rear direction when said support is in the forward travelling condition.

* * * * *